United States Patent [19]

Soderberg

[11] Patent Number: 4,681,167

[45] Date of Patent: Jul. 21, 1987

[54] APPARATUS AND METHOD FOR AUTOMATICALLY AND PERIODICALLY INTRODUCING A FLUID INTO A PRODUCING OIL WELL

[75] Inventor: Paul B. Soderberg, Houston, Tex.

[73] Assignee: Soderberg Research & Development, Inc., Houston, Tex.

[21] Appl. No.: 735,382

[22] Filed: May 17, 1985

Related U.S. Application Data

[63] Continuation-in-part of Ser. No. 618,469, Jun. 8, 1984.

[51] Int. Cl.[4] ..... E21B 43/00; E21B 37/06; E21B 34/10; E21B 34/14

[52] U.S. Cl. ..... 166/371; 166/53; 166/304; 166/323; 166/374; 251/14; 251/114

[58] Field of Search ..... 166/53, 64, 250, 303, 166/304, 319–321, 323, 332, 371, 373, 374, 386; 251/14, 62, 63.5, 111, 114

[56] References Cited

U.S. PATENT DOCUMENTS

| | | | |
|---|---|---|---|
| 3,361,205 | 1/1968 | Waldron | 166/304 |
| 3,794,112 | 2/1974 | Hill | 166/321 X |
| 3,973,586 | 8/1976 | Hill et al. | 166/321 X |
| 4,049,057 | 9/1977 | Hewes | 166/304 |
| 4,132,268 | 1/1979 | Harrison | 166/64 X |
| 4,204,574 | 5/1980 | Stalder | 166/53 X |
| 4,257,484 | 3/1981 | Whitley et al. | 166/321 X |
| 4,331,315 | 5/1982 | Geison | 166/321 X |
| 4,398,604 | 8/1983 | Krajicek et al. | 166/53 X |
| 4,407,367 | 10/1983 | Kydd | 166/304 X |
| 4,429,747 | 2/1984 | Williamson, Jr. | 166/321 |
| 4,452,310 | 6/1984 | Pringle et al. | 166/321 X |

FOREIGN PATENT DOCUMENTS

| | | | |
|---|---|---|---|
| 1063010 | 9/1979 | Canada | 166/53 |
| 2521661 | 11/1975 | Fed. Rep. of Germany | 166/53 |
| 2549692 | 5/1976 | Fed. Rep. of Germany | 166/53 |
| 2080365 | 2/1982 | United Kingdom | 166/321 |
| 926244 | 5/1982 | U.S.S.R. | 166/250 |

*Primary Examiner*—Stephen J. Novosad
*Assistant Examiner*—John F. Letchford
*Attorney, Agent, or Firm*—Browning, Bushman, Zamecki & Anderson

[57] ABSTRACT

The present invention discloses an apparatus and method for periodically and automatically introducing fluid into a producing well through a tubing drain valve in the production tubing. The apparatus and method of the present invention employ a tubing drain valve actuated to its open position by pressurizing the interior of the production string. The system further includes apparatus for introducing a fluid, e.g., a paraffin solvent or formation treating chemical, into the production tubing and into the formation through the opened tubing drain valve. After completion of this operation, the tubing drain valve is closed and production resumed by a mechanical actuator, preferably an actuator carried by the sucker rods for operating the downhole pump. A control device, including optional monitoring devices, provides a system for introducing such fluids at periodic intervals. Although these intervals may be predetermined and constant, it is preferred that the system include timing and monitoring devices so that fluid introduction occurs at variable intervals determined by one or more production characteristics, e.g., only when the rate of production decreases below a predetermined minimum acceptable value.

17 Claims, 10 Drawing Figures

FIG. 1
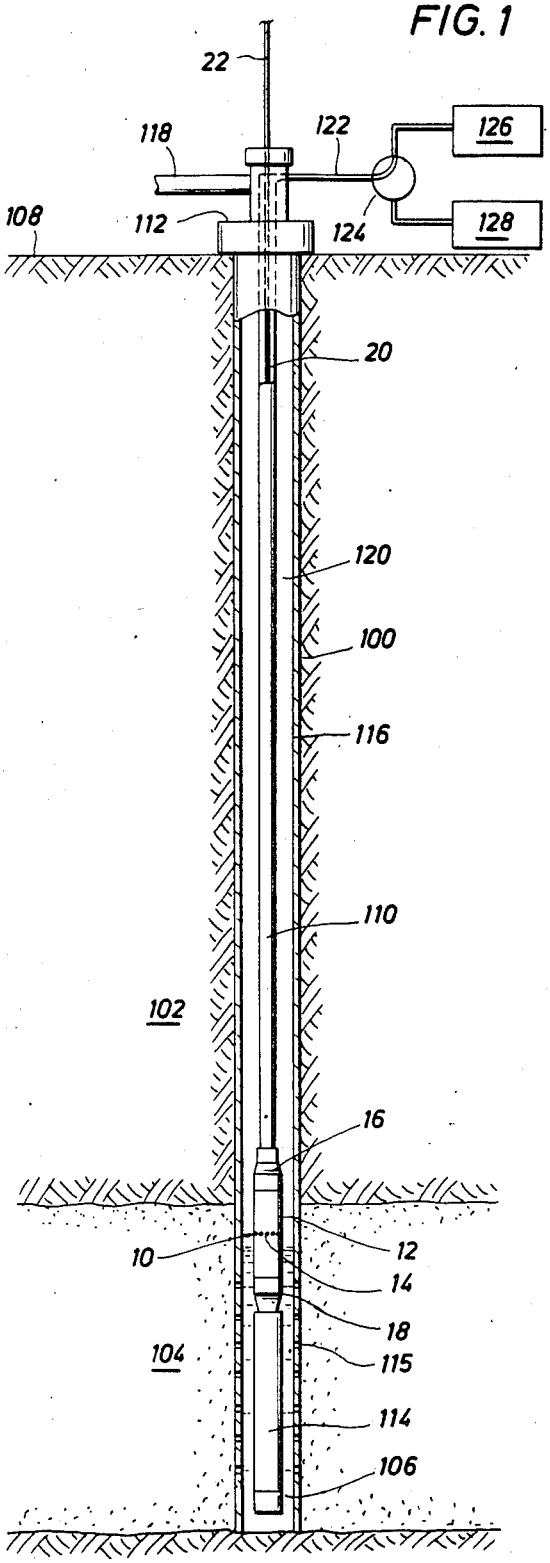
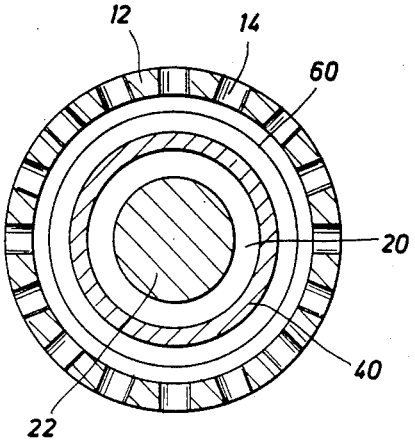
FIG. 4

FIG. 5
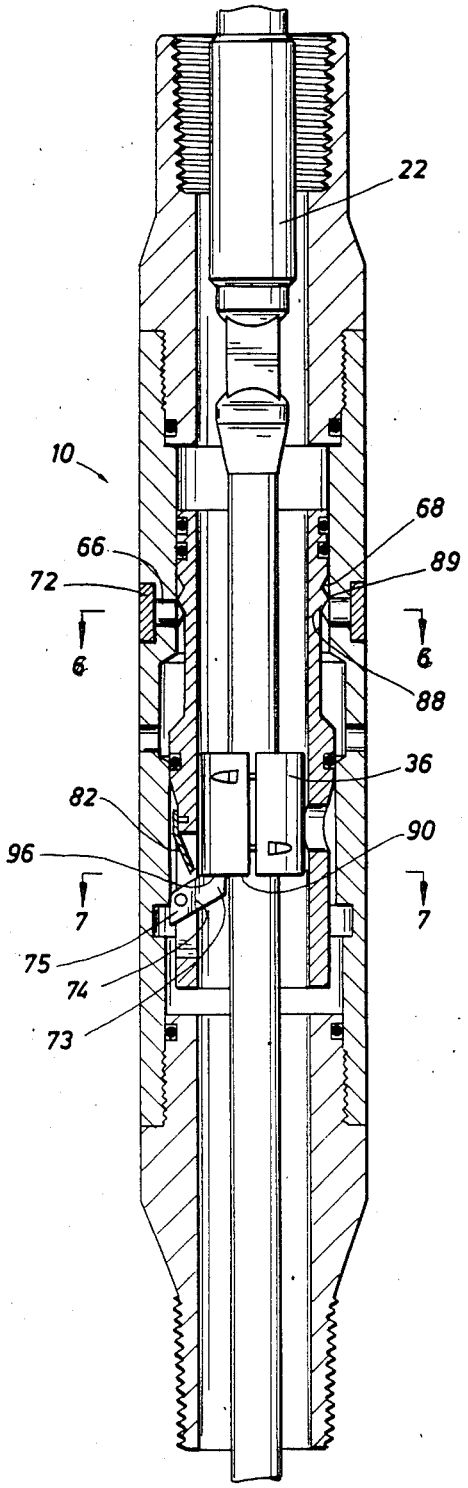
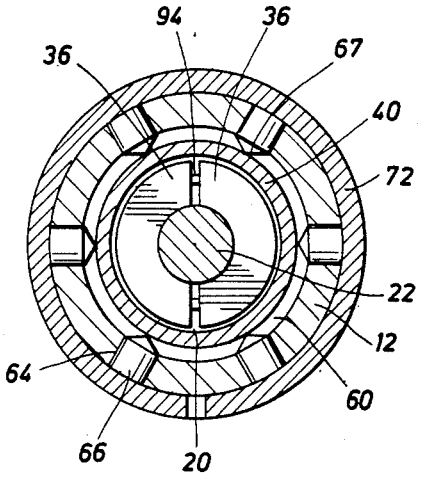
FIG. 6
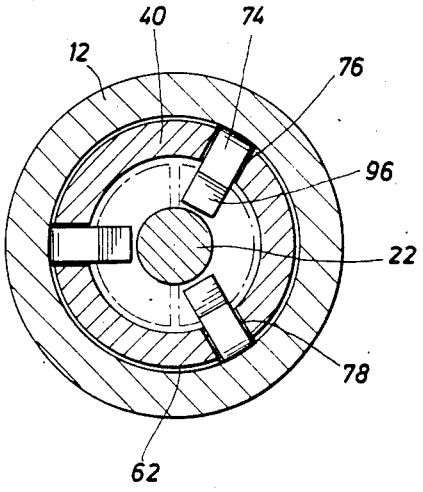
FIG. 7

FIG. 8
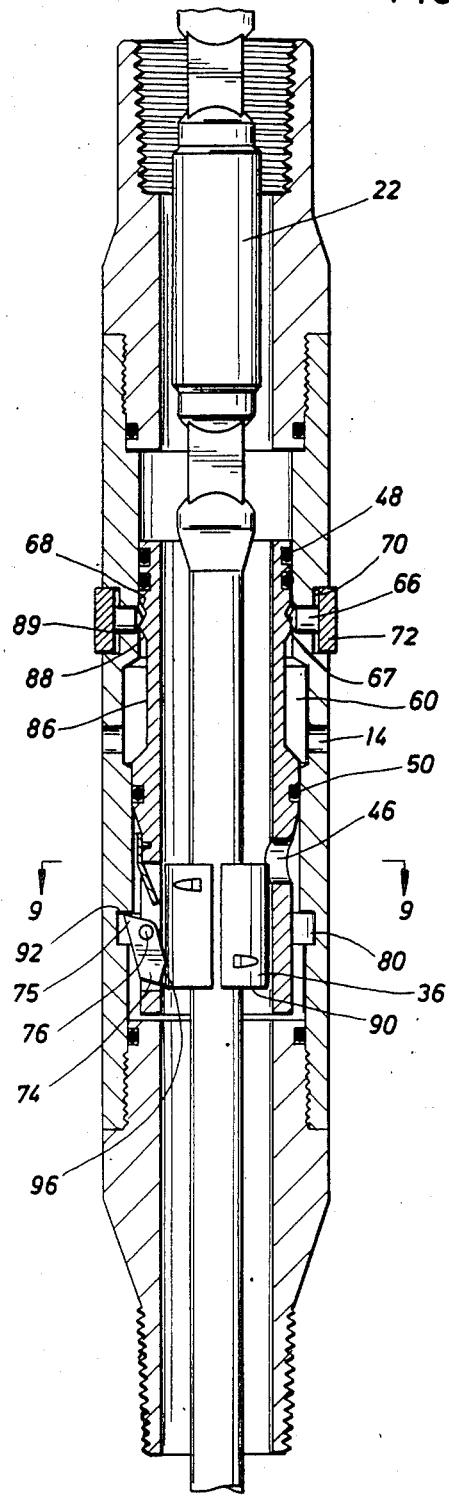
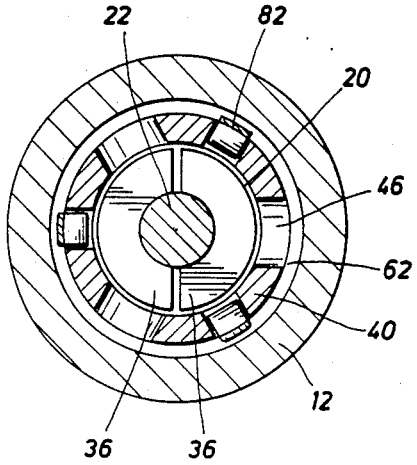
FIG. 9

APPARATUS AND METHOD FOR AUTOMATICALLY AND PERIODICALLY INTRODUCING A FLUID INTO A PRODUCING OIL WELL

CROSS REFERENCE

This is a continuation-in-part of co-pending U.S. patent application Ser. No. 618,469 filed June 8, 1984.

BACKGROUND OF THE INVENTION

1. Field of the Invention

The present invention generally relates to an apparatus and method for automatically and periodically introducing a fluid into a producing oil well. The present invention is particularly useful in a production string where it provides a convenient apparatus and method for routinely, automatically and periodically draining production fluid from the string in order to permit regular injection of chemicals into the producing formation or injection of solvents or hot fluid to dissolve paraffin deposited in the production tubing. More particularly, the present invention relates to an apparatus and method employing a tubing drain valve actuated to its open position by application of a force developed across a movable piston by the pressure in the interior of the production string coupled with positive closing by mechanical means, together with sensing and actuating devices to permit regular, periodic and automatic injection of fluid into a producing well.

2. Description of the Background

It is often desirable to have a drain valve located in the wall of a borehole tubing string. It is particularly desirable to have a tubing drain valve located in a production string for a variety of reasons. For example, the efficiency of production strings is often decreased by the deposit of paraffin, wax and similar substances on the interior of the string as the string rises through lower temperature zones from a deep, high temperature production zone. It is necessary to remove these deposits in order to maintain the efficiency of the production string. Ideally, an automated and prescheduled treating before production is adversely affected would be desirable.

Present methods for removing such deposits employ hot oil, water or steam which is generally forced down the annulus between the production string and the borehole casing. The hot oil, water or steam enters the production string through the downhole pump and returns to the surface through the string where the elevated fluid temperature slowly dissolves the deposits. Because of the long and circuitous path to the zone of interest, fluid reaching the zone of interest is often at a temperature significantly lower than the injected fluid. It is often desirable to inject the producing zone with a variety of chemicals to increase or aid production. These chemicals also are injected by the previously described method for injecting hot oil, steam or hot water. These methods suffer from the disadvantage that excessive quantities of fluids and chemicals are required because the injection is indirect through the annulus. Alternatively, dedicated, small diameter injection tubing is employed to directly inject chemicals into the production zone. Systems for carrying out the above processes must be performed by field personnel on a routine or as needed basis.

In an attempt to solve some of the above problems, others have proposed a variety of valves suitable for use in a borehole production string. For example, valves which open when the pressure within the tubing exceeds a pre-determined pressure have been proposed. Such valves permit fluid communication between the interior of the production string and the annulus at the valve location. These valves are useful for draining the production fluid above the valve location and for injecting chemicals into the borehole at the valve location only if the valve remains open after its initial opening. It is still necessary to pull the production string in order to close these valves. Accordingly, these valves are of no value in the assembly of an automatic treating system. Alternatively, other check valves, e.g., spring loaded valves, operable above a predetermined pressure permit injection of fluids into a borehole at the valve location, but fail to provide a means for draining fluid from the production string.

Accordingly, there has been a long felt but unfulfilled need within the industry for an apparatus and method for automatically introducing a fluid into a producing well. Such a system would require a tubing drain valve which is both opened and closed automatically and reliably from the surface. This valve must also be easily maintained in the open position in order to permit drainage of the production string. Further, this valve must be positively closable from the surface to permit resumption of production.

SUMMARY OF THE INVENTION

The present invention provides a new and improved apparatus and method for periodically and automatically injecting a fluid into a producing well. This apparatus and method employ a valve actuated to its open position by a force developed across the working surfaces of a movable piston and positively actuated to its closed position by mechanical means. The valve of the present invention is preferably actuated to its open position by increased pressure within the pipe string created at predetermined intervals. The opening of the valve actuates injection of a predetermined quantity of solvent into the producing well. Actuation of the valve to its closed position is achieved when engagement surfaces of the valve are engaged by an object being moved through the pipe string.

A tubing drain valve useful with the present invention comprises a passage between the interior and the exterior of a sub suitable for incorporation within a borehole pipe string together with a valve means therein to open and close the passage. The valve means is actuated to its open position by a force developed across the working surfaces of a movable piston and actuated to its closed position by a mechanical means. The valve is preferably actuated to its open position when the pressure in the interior of the sub exceeds a predetermined pressure. In a presently preferred embodiment, the valve comprises a tubular piston sealably and slidably positioned within the sub and having a port for cooperation with the passage of the sub. The valve further comprises a means for biassing the piston to its closed position, preferably provided by a cooperating boss and detent on the piston and sub urged together by a cooperating C-spring. In the presently preferred embodiment, the valve further comprises a means for biassing the valve in its open position, conveniently provided by a similar boss, detent and C-spring arrangement. In the presently preferred embodiment, the valve further includes a pivotally mounted dog engageable on a first arm by an actuating device insertable through the interior of the pipe string and engaging with a second arm a surface of the sub for urging the valve to its closed position. The valve is conveniently actuated to its closed position by an engaging device attached to a wireline or preferably to the sucker rods operating the downhole pump.

The tubing drain valve described above is conveniently incorporated within a string of production tubing suitable for suspension in a producing well. This system includes a conventional string of sucker rods connecting downhole and surface pumps. Further, the system includes conventional hydraulic pump means and valves for pressurizing the interior of the production tubing to a pressure sufficient to actuate the tubing drain valve to its opened position and automatic metering means for introducing a fluid into the production tubing. Finally, the system includes a control device for automatically and periodically controlling the operation of the above components. Exemplary control devices include conventional data accumulation, comparator and switching devices capable of controlling the various pumps and valves at predetermined intervals. In another embodiment of the present invention, the control device further comprises devices for monitoring the values of one or more production characteristics, e.g., the rate of production from the well and means for comparing the monitored value to a predetermined value for controlling fluid introduction at variable periodic time intervals. In a preferred system, the rate of production is monitored and fluid introduciton automatically actuated when the rate of production falls below a predetermined minimum acceptable value.

The method of operation of the above value comprises applying a first biassing force to maintain the valve in its closed position, applying a sufficient force to the valve piston to overcome the biassing force and to actuate the valve to its open position and applying a sufficient force by mechanical means to the piston to actuate the valve to its closed position. The biassing force is applied by a cooperating boss, detent and C-spring arrangement as described above. Further the presently preferred method of the present invention comprises applying a biassing force to maintain the valve in its open position. This second biassing force is conveniently applied by means similar to that employed for applying the first biassing force. In the presently preferred embodiment, the opening force is produced by increasing the pressure in the interior of the piston and sub to a pre-determined pressure to develop the required force across the working surfaces of a movable piston. Finally, the presently preferred method comprises applying a sufficient force to overcome the second biassing force and to actuate the valve to its closed position by lever means.

A further extension of the method of the present invention comprises injecting a fluid, e.g., hot water, steam, solvent or a variety of chemicals, into the borehole through the open valve. The method of the present invention comprises temporarily, automatically and at periodic time intervals disabling the production means, opening the tubing drain valve as described above, introducing the desired fluid into the producing well from a fluid reservoir through the production tubing and the opened tubing drain valve, closing the tubing drain valve by a mechanical actuator within the production tubing and resuming production by enabling the production means.

The device and method of the present invention solve the long felt but unfulfilled need for an effective apparatus and method for automatically and periodically introducing a fluid into a producing well. Such a device permits the production fluid to be automatically and periodically drained from the production string when necessary to permit injection of fluids, e.g., hot water, steam, solvents and chemicals, directly into the production tubing at the surface and into the formation through the drain valve. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings wherein:

FIG. 1 is a representation of a borehole having a sub including a tubing drain valve located near the top of a producing formation;

FIG. 4 is a cross-sectional illustration of a tubing drain valve in accord with the present invention through the plane 4—4 of FIG. 2;

FIG. 5 is a cross-sectional illustration of a tubing drain valve in accord with the present invention wherein the engaging device on a sucker rod is moving the valve downward toward its closed position;

FIG. 6 is a cross-sectional illustration of a tubing drain valve in accord with the present invention through the plane 6—6 of FIG. 5;

FIG. 7 is a cross-sectional illustration of a tubing drain valve in accord with the present invention through the plane 7—7 of FIG. 5;

FIG. 8 is a cross-sectional illustration of a tubing drain valve in accord with the present invention wherein the valve is being sprung to its closed position by the biassing means; and FIG. 9 is a cross-sectional illustration of a tubing drain valve in accord with the present invention through the plane 9—9 of FIG. 8.

Figure 2:
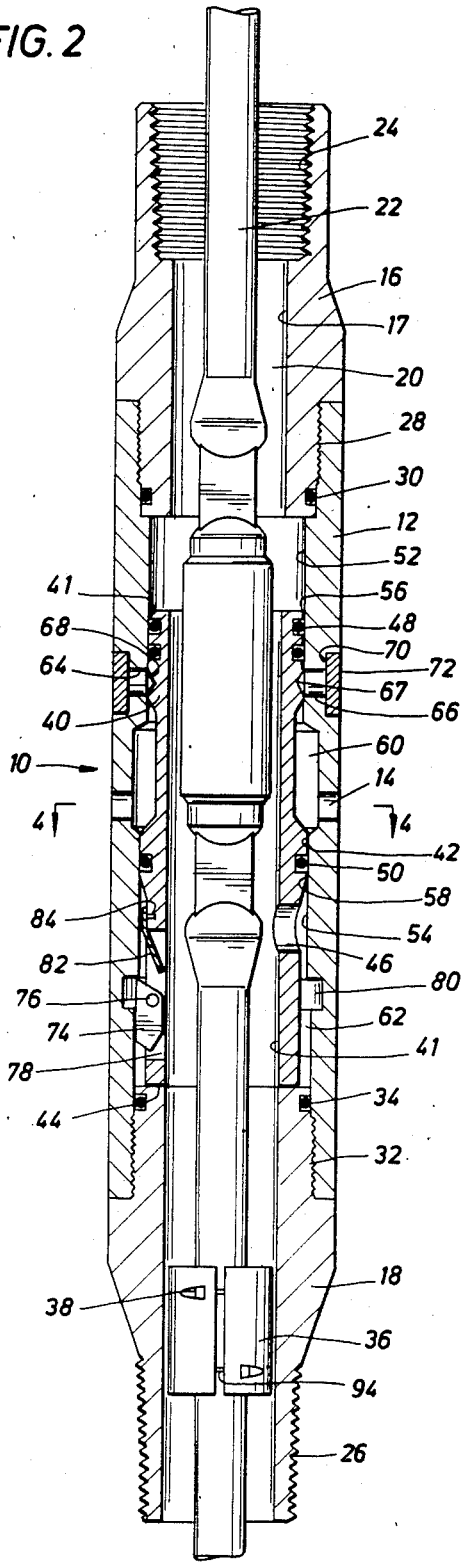
FIG. 2 is a cross-sectional illustration of a sub including a tubing drain valve in accord with the present invention in the closed position.

While the invention will be described in connection with a presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

FIG. 1 illustrates a pipe string 110 disposed within a borehole 100 through a formation 102 to the producing zone 104. The pipe string 110 comprises a plurality of tubular members interconnected and suspended from the surface 108 to the producing zone 104. At the lower end of the pipe string 110 is a production pump 114 submerged within the production fluid 106. The production fluid 106 enters the annulus 120 through perforations 115 in the casing 116. Although the illustrated borehole is cased, as is typical in producing wells, it is not necessary that the borehole be cased. The downhole pump 114 is actuated by a conventional string of sucker rods 22 passing through the interior 20 of the pipe string 110. This string of sucker rods 22 is operable by any conventional well head device, e.g., a grasshopper pump. Production fluids are pumped to the surface 108 through a well head 112 and appropriate pipes 118 to a conventional storage tank, pipeline or the like (not illustrated).

FIG. 1 illustrates a tubing drain valve sub 10 located within the pipe string just above the downhole pump 114 near the upper limit of the producing zone 104. The tubing drain valve sub 10 comprises a tubular member 12 sealingly engaged between an upper connector 16 and a lower connector 18 in the pipe string. The tubular member 12 includes a plurality of ports or fluid passageways 14 capable of providing fluid communication between the interior 20 of the drain valve sub and the annulus 120 of the borehole. FIG. 1 also illustrates representationally a pressure source 126 connected by pressure tubing 122 and a three-way valve 124 for pressurizing the interior of the pipe string and the tubing valve sub 10. Also illustrated is a fluid source 128 for communicating or injecting a fluid into the pipe string 110 and, optionally, into the formation through the ports 14 of the tubing drain valve sub 10. Those skilled in the art will be aware of many conventional systems for downhole injection of a variety of fluids, e.g., high temperature water, steam, treating chemicals and the like, which may be substituted for the fluid source 128 of the present invention.

Referring now to FIGS. 2–9, with particular emphasis on FIG. 2, a presently preferred tubing drain valve sub 10 in accord with the present invention is illustrated in more detail. The tubing drain valve of the present invention is suitable for use in a borehole pipe string and comprises a sub 10 suitable for incorporation within a borehole pipe string 110. The sub 10 comprises a tubular member 12 suitable for incorporation within a borehole pipe string. The tubular member 12 is threadedly engaged 28 with an upper, annular connector 16 which in turn is threaded 24 for incorporation within a borehole pipe string. Sealing engagement between the tubular member 12 and the upper connector 16 is provided by O-ring seal 30. At its other end, the tubular member 12 is threaded 32 for engagement with a lower, annular connector 18 which in turn is threaded 26 for incorporation within a borehole pipe string. Sealing engagement between the tubular member 12 and the lower connector 18 is provided by O-ring seal 34. The tubular member 12 is characterized by a plurality of ports or passageways 14 capable of providing fluid communication between the interior and exterior of sub 10. In a presently preferred embodiment, a plurality of ports 14 are symmetrically spaced about the sub 10. For example, in FIG. 4 sixteen ports 14 are symmetrically spaced about a plane passing through the central cross section of the tubular member 12.

The tubing drain valve sub 10 further comprises valve means to open and close the ports 14 wherein the valve means is actuated to its open position by a force developed across the working surfaces of a movable, tubular piston 40 and is actuated to its closed position by a mechanical means, conveniently an engaging device 36 attached to a sucker rod 22. A string of conventional sucker rods 22 passes through central bore 20 of the pipe string 110 and the sub 10. It is preferred that the diameter of the interior surface 41 of the piston 40 be at least as great as the diameter 17 of the interior surface of the connectors 16, 18 and the pipe string 110 in order to permit unobstructed passage of objects, e.g. the downhole pump, through the sub 10. Tubular piston 40 is characterized by an exterior 41, 42 adapted for sealing cooperation with the interior 52, 54 of the tubular member 12 such as with O-ring seals 48, 50 on opposite sides of the ports 14. In a presently preferred embodiment, the tubular piston 40 further comprises one or more ports 46 therethrough for cooperation with the ports 14 as through passage 62 and chamber 60 to permit fluid communication from the interior 20 to the exterior 120 of the sub 10.

The tubing drain valve sub 10 further comprises means for biassing the tubular piston 40 to its closed position. The biassing means is conveniently provided by one or more bosses 67 on the tubular member 12 cooperating with one or more detents 68 on the piston 40. In a presently preferred embodiment, the bosses 67 comprise the conical end of a plurality of plugs 66 inserted within bores 64 through the tubular member 12. See FIG. 6 where an arrangement including six, symmetrically spaced bosses is illustrated. These bores 64 and bosses 67 are symmetrically located about the tubular member 12 within a groove 70. The plugs 66 are urged inwardly by a C-spring 72 which provides the desired biassing force. The force required to actuate the valve of the present invention to its open position is determined by the strength of the C-spring 72. It is within the ability of those skilled in the art to produce a valve in accord with the present invention which is operable at any desired force by the judicious selection of the C-spring 72. The cooperating detent in the piston 40 is conveniently provided by a circumferential groove 68 shaped to cooperate with the conical bosses 67 on the plugs 66.

The valve of the present invention further comprises means for biassing the piston 40 in its open position. Such means is again conveniently provided by a cooperating boss and detent arrangement. In a presently preferred embodiment, the boss 67 and C-spring 72 arrangement described above cooperate with a second detent, provided by a second groove 86 located on the exterior surface of the piston 40 below the first detent 68. This second groove 86 need not be a narrow groove like first groove 68, but may be characterized by a substantial width along the longitudinal axis of the piston 40. In the open position, the piston 40 need not by biassed to a specific position but need only be biassed to a position which permits fluid communication from the interior 20 to the exterior 120 of the sub 10 through ports 14.

The interior diameter of the tubular member 12 is characterized by two different diameters, one on either side of ports 14. The diameter of the bore at 52 is less than the diameter of the bore at 54. Accordingly, the cooperating exterior surface of the piston 40 is characterized by a greater diameter at 42 than the diameter at 41. Therefore, the area of the working surface 58 is greater than the area of the working surface 56 and the pressure within the interior 20 of the sub 10 produces a net force acting on the piston 40 across the working surfaces 56, 58 tending to actuate the valve to its open position. When the net force produced by the pressure acting on the surfaces 56, 58 is sufficiently great to overcome the biassing force applied by the C-spring 72 to the bosses 67 and detent 68, the valve opens.

The tubing drain valve sub 10 of the present invention further comprises mechanical means for positively closing the ports 14. The presently preferred embodiment includes lever means which are actuated by an engaging means affixed to a sucker rod 22 for moving the piston 40 to its closed position. The engaging means is conveniently provided by a plurality of interconnected devices, e.g., two semi-cylindrical members 36 interconnected about a sucker rod 22 as by screws 94 in recesses 38. The engaging means is characterized by having a surface 90 capable of engaging the lever means.

Figure 3:
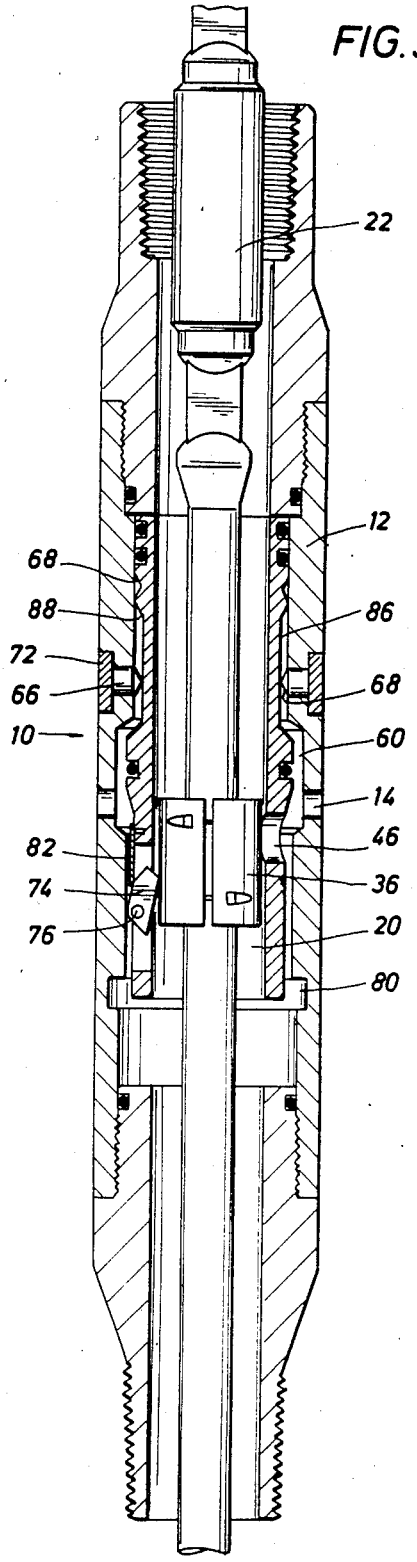
FIG. 3 is a cross-sectional illustration of a sub including a tubing drain valve in accord with the present invention in an open position and wherein the engaging device on a sucker rod is being pulled upward through the sub.

In a presently preferred embodiment, the lever means is provided by one or more dogs 74 pivotally mounted about axles 76 within recesses or openings 78 in the piston 40. See FIGS. 7 and 9 which illustrate a presently preferred embodiment comprising three dogs 74 symmetrically located about the piston 40. When the piston 40 is in the closed position, the dog 74 preferably do not project within the cetral bore 20 defined by diameter 17 of the pipe string. However, as the piston 40 is opened, one end 75 of the dog 74 engages a surface 92 of a detent 80 in the tubular member 12, causing the dog 74 to rotate about its mounting axle 76 to the position illustrated in FIG. 5. However, a leaf spring 82 attached as at 84 to the piston 40 and projecting into the opening 78 is positioned to cause the opposite end 73 of the dog 74 to remain projecting within the central bore 20 of the sub 10. However, the spring 82 gives under pressure of dog 74 when forced by the engaging device 36 or other objects being raised through the sub, e.g., a downhole pump being pulled, permitting the dog 74 to retract within the opening 78, freeing the central bore 20 for unobstructed passage as illustrated in FIG. 3.

The valve of the present invention is easily closed by mechanical means by lowering an engaging means such as device 36 through the central bore 20. The device 36 is characterized by an engaging surface 90 for engaging the surface 96 of the arm 73 of the dog 74 projecting into the central bore 20 by the action of the spring 82 and the shape of the dog 74. As the engaging device 36 is lowered, the dog 74 pulls the piston 40 toward its closed position. As the piston passes the location illustrated in FIG. 5, the dog 74 becomes free to rotate about its axle 76 directing the arm 75 into the detent 80. As this rotation continues, the end of the arm 75 contacts the surface 92 of the detent 80 causing the dog 74 to act as a lever to pull the piston 40 downward. This downward motion pulls the boss 67 of the plug 66 along the surface 88. When the downward force applied by the engaging device 36 is sufficiently great to overcome the biassing force of the C-spring 72, the plugs 66 are forced outwardly over the surface 88 until maximum expansion is reached at point 89. As point 89 is passed, the biassing force applied by the C-spring 72 drives the boss 67 into the groove 68, further driving the piston 40 into its locked position.

It is believed that those skilled in the art will fully understand the operation of the valve of the present invention based on the above desription. However, the method for operating a valve means in accord with the present invention will be briefly summarized below. This method applies to the operation of a valve means comprising a tubular piston 40 movable within a tubular member 12 suitable for use in a borehole pipe string 110 to open and close a port 14 through the wall of the tubular member 12. The method comprises applying a first biassing force to maintain the valve means in its closed position, applying pressure to develop a sufficient force across the working surfaces 56, 58 of the piston 40 to overcome the first biassing force and to actuate the valve means to its open position and, finally, applying sufficient force by mechanical means to the piston 40 to actuate the valve means to its closed position.

The first biassing force is preferably applied by a C-spring 72 to a cooperating boss 67 and detent 68 arrangement as described above. Accordingly, by choosing a C-spring 72 of appropriate strength, it is possible to apply any desired biassing force. The opening force is conveniently developed by increasing the pressure in the interior 20 of the piston 40 and the tubular member 12 to a pressure sufficient to produce the required force. This force is produced by the interior pressure acting upon the working surfaces 56, 58 of the piston 40 by well known principles. In a presently preferred method, the strength of the C-spring 72 is chosen so that the valve means does not open until the interior pressure exceeds the maximum expected working pressure in the pipe string 110 by about 1000 psi.

The method of the present invention further comprises applying a second biassing force when the valve means is in its open position to maintain the valve means in its open position. In a presently preferred method, this second biassing force is applied by a cooperating boss, detent and C-spring arrangement as previously discussed. In fact, in a presently preferred embodiment, the same C-spring 72 and boss 67 merely cooperate with another detent 86 to provide this force.

The presently preferred method for actuating the valve of the present invention to its closed position comprises engaging a lever means on the piston 40 to apply a sufficient force to overcome the second biassing force to actuate the valve means to its closed position. In the presently preferred embodiment, a first arm 73 of a dog 74 pivotally mounted on the piston 40 is engaged with an engaging device 36 insertable through the interior of the tubular piston 12. The engaging device 36 is preferably an engaging surface of a device attached to a sucker rod 22 for operating the downhole pump 114. The method further comprises moving the piston 40 relative to the tubular member 12 to a position where the dog 74 is capable of rotating about its pivot 76 to bring a second arm 75 of the dog 74 into contact with a detent 80 on the tubular member 12. Finally, sufficient force is applied to the first arm 73 by the engaging means 36 to continue rotation of the dog 74 about its pivot 76 while the second arm 75 of the dog 74 engages the detent 80 in order to overcome the second biassing force to actuate the valve to its closed position.

The apparatus and method of the present invention provide a tubing drain valve biassed to both its opened and its closed positions. The tubing drain valve of the present invention is actuated to its opened position when the force developed by the pressure on the interior of the pipe string across the working surfaces of the valve piston is greater than the force biassing the valve to its closed position. The tubing drain valve of the present invention is actuated to its closed position when the force applied by a mechanical means, preferably a mechanically actuated lever means, is greater than the force applied by the means biassing the valve to its open position.

The present invention provides a valve actuated from the surface, preferably pressure opened and mechanically closed. The valve of the present invention remains open after the force applied to open the valve has been removed. A valve in accord with the present invention is conveniently employed in a production string for injecting chemicals into the formation at the location of the valve by permitting the production fluid to be drained from the pipe string and the fluid or chemicals to be directly injected through the pipe string and valve into the formation. Finally, this valve is particularly useful for removing paraffin, wax and other deposits from the interior of a production string by permitting the production fluid to be drained therefrom and hot water or steam to be injected directly into the pipe string at the surface to dissolve the deposits. This system greatly reduces the quantities of fluids, chemicals, hot water or steam necessary for the above operations. These exemplary uses and advantages derived from the valve of the present invention are not meant to be exhaustive or complete but are merely illustrative.

Figure 10:
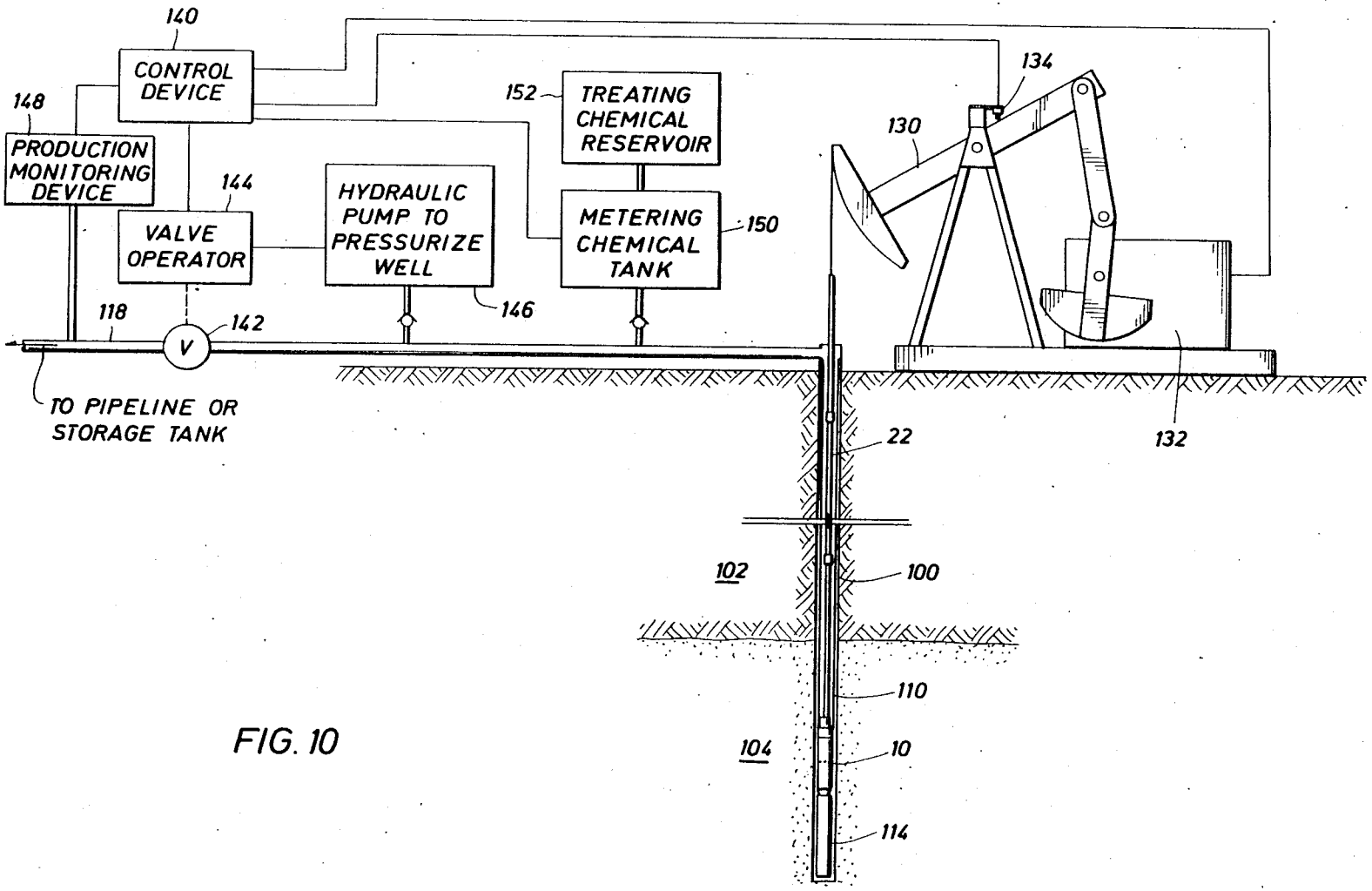
FIG. 10 is a schematic illustration of the system of the present invention for automatically and periodically controlling the introduction of a fluid into a producing well.

An exemplary system in accord with the present invention is illustrated in FIG. 10 wherein a tubing drain valve sub 10 as described above is disposed in a production string 110 disposed within a borehole 100 through a formation 102. Disposed within the production string 110 is a string of sucker rods 22 connecting the downhole pump 114 with the surface pump 130, illustrated as a walking beam pump 130 of a type well known to those skilled in the art. The pump 130 includes a conventional motor 132 for operating the sucker rods 22 and downhole pump 114 so that well fluids are conveyed from the producing zone to a surface pipe line 118. The system of the present invention further comprises a conventional valve 142 and valve actuator 144 for isolating the production tubing 110 from the surface pipe line 118 during the time that fluids are being injected into the well. Further, the system includes a conventional hydraulic pump 146 for pressurizing the isolated production string 110 to a pressure sufficiently high to actuate the tubing drain valve of sub 10 to the open position as described in greater detail above. Also included in the system of the present invention is a conventional metering device 150 in fluid communication with the production tubing 110 through which the fluid to be introduced into the well is metered into the production tubing 110. Preferably, the system of the present invention further includes a fluid reservoir 152 in fluid communication with the metering device 150 for replenishing the fluid introduced therefrom. Finally, in a preferred embodiment, the system of the present invention includes one or more monitoring devices 148 for monitoring characteristics of the well production. In the presently preferred embodiment, the monitoring device 148 is a conventional fluid flow or rate meter from which the production rate from the well is determined.

Finally, the system of the present invention includes a control device 140 for controlling the above components. In a simple embodiment of the present invention, the control device 140 includes a timer for periodically and automatically controlling the above components to introduce fluid into the well. Such a simple arrangement provides a means for automatically injecting fluid at predetermined intervals, preferably predetermined to be less than the time at which the well production is expected to deterioriate to an unacceptable rate. In a more preferred and complex system, the control device includes a comparator permitting the injection system to be operated at variable periods. An exemplary preferred device includes a comparator having stored therein predetermined values for one or more characteristics of the production, most preferably and conveniently a minimum acceptable value for the production rate. As paraffin deposits accumulate within the production tubing, the effective cross section of the tubing decreases, resulting in the rate of production slowly decreasing. Such a decreased rate of production is conveniently monitored by a monitoring device or meter 148. A conventional rotary metering device which produces a signal to reset a timer in the control device after a given volume of fluid has passed through the meter is preferred. The control device 140 is easily programmed to actuate the sequence of events when the timer reaches a predetermined time without being reset. When the production rate decreases to an unacceptable level, the timer is not reset but will reach the predetermined time at which the control device actuates the sequence of events causing injection of the fluid into the well.

In an exemplary system, this sequence of events comprises the disabling of the string of sucker rods 22 so that the actuator 36 is in a predetermined position relative to the tubing drain valve. In a presently preferred embodiment, a tubing drain valve in accord with the present invention, e.g. that illustrated in FIGS. 2–5, is disposed within the production tubing 110 in a configuration upside down from that illustrated in FIG. 2 so that the actuator 36 is below the tubing drain valve when the sucker rods 22 are disabled. In this preferred configuration, a proximity switch 134 actuated by the control device 140 upon reaching the predetermined time, is employed on the surface pump 130 so that the control device 140 detects when the actuator 36 is in its lowermost position. Upon the detection of this configuration by the proximity switch 134, the control device 140 temporarily disables the sucker rods 22 and pump 130 by terminating power to the motor 132. The control device 140 thus initiates pressurization of the interior of the production tubing 110 by closing the valve 142 with the valve actuator 144 and by actuating a conventional hydraulic pump 146. The interior of the production tubing 110 is pressurized by the hydraulic pump 146 to a pressure sufficient to open the tubing drain valve. As the tubing drain valve opens, the fluid within the production string is released through the valve into the formation, resulting in a drop in pressure within the production string. The fluid to be injected into the production tubing and/or well is contained within an injection or metering device 150 of conventional design which is actuated by any convenient means, including another signal from the control device 140 or in response to the pressure drop within the production string or the differential pressure between the metering device 140 and the interior of the production string 110. Further pumping with the hydraulic pump 146 or a pump in fluid communication with the metering device 150 conveys the injected fluid, e.g., a paraffin solvent or chemical treating fluid, through the production tubing 110 and the opened tubing drain valve into the formation.

This system provides an automatic and periodic means for dissolving unwanted paraffin from the interior of the production tubing and/or for injecting treating chemicals into the formation. After a predetermined time or after a predetermined volume of fluid has been injected, the control device 140 disables the hydraulic pump 146, opens the valve 142 by means of valve actuator 144 and reactivates the surface pump 130. In the preferred embodiment, as the surface pump 130 is reactivated and moves upward through the first stroke, the mechanical actuator 36 will engage the lever arms 74 of the tubing drain valve to close the tubing valve, permitting production to resume.

The foregoing description of the invention has been directed in primary part to a particular preferred embodiment and method in accordance with the requirements of the patent statutes and for purposes of explanation and illustration. It will be apparent, however, to those skilled in the art that many modifications and changes in the specifically described apparatus and method may be made without departing from the scope and spirit of the invention. It will be apparent to those skilled in the art that the tubing drain valve sub also may be mounted as illustrated in FIGS. 2–5 so that the actuator would be disabled above the sub and the first downward stroke of the reactivated pump would close the valve. This and many other changes in the means for accomplishing various phases of the present system are readily apparent to those skilled in the art. Therefore, the invention is not restricted to the particular form of construction and method illustrated and described, but covers all modifictions which may fall within the scope of the following claims.

It is applicant's intention in the following claims to cover such modifications and variations as fall within the true spirit and scope of the invention.

What is claimed is:

1. A method for periodically and automatically introducing a fluid into a producing well through a tubing drain valve in a string of production tubing, comprising:

disabling temporarily, automatically and at periodic time intervals a string of sucker rods disposed within said string of production tubing between a surface-located means for operating said sucker rods and a downhole pump so that a mechanical actuator on said string of sucker rods is stopped in a predetermined position on one side of a lever means of said tubing drain valve;

opening said tubing drain valve by pressurizing the interior of said production tubing to a pressure sufficient to actuate said tubing drain valve to its opened position;

introducing a fluid into said production tubing in response to the opening of said tubing drain valve;

conveying said introduced fluid into said producing well through said tubing drain valve;

enabling said string of sucker rods; and closing said tubing drain valve by moving said lever means on said valve with said mechanical actuator as a result of the enablement of said string of sucker rods.

2. The method of claim 1 comprising disabling said sucker rods by actuating a proximity switch at periodic time intervals;

sensing with said proximity switch when said mechanical actuator is in said predetermined position; and disabling said means for operating said sucker rods.

3. The method of claim 1 comprising stopping temporarily said mechanical actuator below said lever means.

4. The method of claim 1 comprising stopping temporarily said mechanical actuator above said lever means.

5. The method of claim 1 comprising pressurizing the interior of said production tubing by actuating a high pressure hydraulic pump in fluid communication with the interior of said production tubing and a valve means for closing the surface outlet of said production tubing.

6. The method of claim 5 wherein said valve means is actuated in response to a predetermined pressure within said production tubing.

7. The method of claim 5 wherein said valve means is actuated in response to a predetermined pressure differential acting on said valve means.

8. The method of claim 1 comprising introducing said fluid through an automatic metering means.

9. The method of claim 8 further comprising automatically resupplying said fluid to said metering means from a fluid reservoir.

10. The method of claim 1 wherein said introduced fluid includes a solvent for paraffin typically deposited in production tubing and further comprising:

dissolving said paraffin in said fluid and conveying said dissolved paraffin to the exterior of said production tubing through said opened tubing drain valve.

11. The method of claim 1 wherein said introduced fluid includes a chemical for treating the earth formation on the exterior of said production tubing and further comprising treating said formation with said chemical conveyed through said opened tubing drain valve.

12. The method of claim 1 wherein said time intervals are variable and are determined by monitoring the value(s) of one or more characteristics of well production;

comparing the monitored value(s) to predetermined value(s) of said characteristics; and disabling said string of sucker rods when a monitored value equals or exceeds its corresponding predetermined value.

13. The method of claim 12 comprising monitoring the rate of production from the well and disabling said string of sucker rods when the rate of production falls below a predetermined value.

14. An apparatus useful for periodically and automatically introducing a fluid into a producing well through a tubing drain valve located in a production string, comprising:

a string of production tubing suitable for suspension in a producing well;

surface and downhole pumps connected by a string of sucker rods for lifting well fluids through said production tubing;

a tubing drain valve within said production string, said tubing drain valve actuated to its opened position by increased pressure within said production tubing and actuated to its closed position by movement of a lever means of said value;

means in communication with the interior of said production tubing for pressurizing said production tubing to a pressure sufficient to open said tubing drain valve;

means in communication with the interior of said production tubing for introducing a fluid into said production tubing;

an actuator means disposed on said string of sucker rods for mechanically closing said tubing drain valve by coopertion with said lever means on said valve; and means for controlling automatically the operation of the above components at periodic time intervals for automatically conveying a fluid into said production tubing and through said tubing drain valve.

15. The apparatus of claim 14 wherein said control means comprises a proximity switch for sensing when said actuator means is in a predetermined position relative to said tubing drain valve.

16. The apparatus of claim 15 wherein said means for controlling further comprises means for monitoring the value(s) of one or more characteristics of the well production from said production tubing; and means for comparing the monitored value(s) to predetermined values of said characteristics to determine the time interval at which fluid is conveyed through said tubing drain valve.

17. The apparatus of claim 16 wherein said means for monitoring comprises means for monitoring the rate of production through said production tubing.

* * * * *